United States Patent [19]

Piekos

[11] Patent Number: 4,744,311

[45] Date of Patent: May 17, 1988

[54] SYSTEM FOR FEEDING SOLID PARTICULATE MATERIAL FOR COMBUSTION IN A REACTOR VESSEL

[75] Inventor: Stanley J. Piekos, Holden, Mass.

[73] Assignee: Riley Stoker Corporation, Worcester, Mass.

[21] Appl. No.: 54,943

[22] Filed: May 27, 1987

[51] Int. Cl.[4] ..... F23K 3/10; F23K 3/16

[52] U.S. Cl. ..... 110/108; 110/101 R; 110/101 C; 110/101 CF; 110/278

[58] Field of Search ..... 110/101 R, 101 C, 101 CF, 110/105, 108, 113, 117, 278; 414/160

[56] References Cited

U.S. PATENT DOCUMENTS

| | | | |
|---|---|---|---|
| 1,987,289 | 1/1935 | Gardner et al. | 110/117 |
| 4,250,818 | 2/1981 | Sigg | 110/278 |
| 4,491,077 | 1/1985 | Petty et al. | 110/278 |

*Primary Examiner*—Edward G. Favors

*Attorney, Agent, or Firm*—Mason, Kolehmainen, Rathburn & Wyss

[57] ABSTRACT

A new and improved system for feeding solid particulate material such as refuse derived fuel for burning in a combustion reactor vessel such as a boiler includes a fuel injector chute having a lower end for directing a flow of said solid particulate material into the vessel and an upper end for receiving a flow of said material. A feeder is provided having a discharge end for delivering a continuous controllable flow of said material to the inlet of the injector chute and a plurality of separate, spaced apart, vibratory feed hoppers are mounted above the feeder to supply the feeder with a steady flow of material from one or both hoppers. Each hopper is adapted for holding a reservoir or supply of said solid particulate material and is selectively controllable to provide a steady flow of solid particulate material into the feeder for delivery through the injector chute to the combustion reactor vessel.

11 Claims, 3 Drawing Sheets

14
18
18a
20a
20
16
3
32
38
36
24
40
A
26a
22
20b
2
30
98
44
60
102
56
58
86
90
82
100
68
26
28
84
62
50
10
64a
66
64
52
54
42
46
34
25
74
76
76a
70A
78
80
88
108a
104
110
106
92
94
72
70B 70A
68
30
32
38
22
20b
20
24
44
42
60
56
58
52
54
10
50
46
40
36
25
80
84
82
100
98
102

78
86
88
94
90
92
96
70A
68
30
82
80
24
100
40
25
28
12
26
44
42
46
60
56
58
52
54
10
50
84
36
38
98
102

SYSTEM FOR FEEDING SOLID PARTICULATE MATERIAL FOR COMBUSTION IN A REACTOR VESSEL

BACKGROUND OF THE INVENTION

1. Field of the Invention

The present invention relates to a new and improved system for feeding solid particulate material such as refuse derived fuel and the like for burning in a combustion reactor vessel such as a boiler or furnace. In boilers and furnaces of the type utilizing refuse derived fuel as a fuel, it is desirable to provide a system for feeding the fuel at a selectively controlled rate without interruptions in feed to the reactor vessel. The feeding system of the present invention is adapted to provide a continuous control flow of refuse derived fuel to the boiler without interruption even though the supply of fuel to the feeding system may from time to time be cut off or interrupted for various reasons such as, upstream pluggage.

2. Background of the Prior Art

U.S. Pat. No. 4,598,669 discloses a control process for a system of supplying heat for use in manufacturing processes. The system disclosed is adapted for providing a controlled flow of liquid fuel such as oil to a furnace and the control is effected by means of a digital computer having sensors for electrical, pneumatic, mechanic or hydraulic inputs. U.S. Pat. No. 4,598,670 discloses a solid fuel feed system for a boiler employing an endless belt conveyor system having associated control and alarm devices.

OBJECTS OF THE PRESENT INVENTION

It is an object of the present invention to provide a new and improved system for feeding solid particulate material for combustion in a reactor vessel.

More particularly, it is an object of the invention to provide a plural bin fuel feed system for metering and feeding fuel received from incoming feeder conveyors to a single boiler or furnace inlet chute.

It is an object of the present invention to provide a system of the character described having redundant vibratory bins which are fed by a plurality of separate conveyors and without any static transition chutes in the feed path.

More particularly, it is an object of the present invention to provide a new and improved system as described in the foregoing object wherein boiler outage time is greatly decreased because of the redundant capability in the fuel feeding system.

Another object of the present invention is to provide a new and improved system of the character described as having a plurality of vibrating bins for providing a continuous inventory of fuel available for feeding and thus eliminating or reducing problems of fuel pluggage or flow stoppage.

Another object of the present invention is to provide a new and improved system of the character described having a vibratory feed conveyor for metering and leveling the flow of fuel to a boiler or furnace in chute at a selectively controlled feed rate.

Another object of the present invention is to provide a system of the character described having a substantially uniform feed without interruption throughout a wide control range to accommodate furnace or boiler burning rates from 10% to 100% of design rating.

Another object of the present invention is to provide a new and improved system of the character described having redundancy built in so that static fuel bins are essentially eliminated.

Another object of the present invention is to provide a new and improved feeder system of the character described which eliminates the need for belt conveyors and elevators.

Another object of the present invention is to provide a new and improved system of the character described requiring a minimal expenditure of horsepower, minimal maintenance and a minimal spare parts inventory.

Another object of the present invention is to provide a new and improved system of the character described which promotes optimum system availability, which is capable of precise feed rate control over a wide range of fuel densities and which is exceptionally responsive to immediate load change requests.

BRIEF SUMMARY OF THE PRESENT INVENTION

The foregoing and other objects and advantages of the present invention are accomplished in an illustrated embodiment herein comprising a new and improved system for feeding solid particulate material such as refuse derived fuel for burning in a combustion reactor vessel such as a furnace or steam generating boiler. The system includes a fuel injector chute having a lower end for directing a controlled flow of solid particulate material into the burner section of a reactor vessel and the chute includes an upper end for receiving a flow of particulate material to be burned. A vibratory feeder is provided having a discharge end for delivering a metered and selectively controllable flow rate of particulate material to the inlet end of the ejector chute. The feeder is supplied with fuel from one or more of a plurality of separate, spaced apart vibratory feed bins which are positioned above the vibratory feeder. Each vibratory bin is adapted to hold a redundant supply of solid particulate material and is individually selectively controllable to provide for a continuous, steady flow of particulate material from the vibratory feeder into the delivery injection chute of the combustion reactor.

BRIEF DESCRIPTION OF THE DRAWING

Reference should be had to the following description taken in conjunction with the drawings, in which.

DESCRIPTION OF A PREFERRED EMBODIMENT

Figure 1:
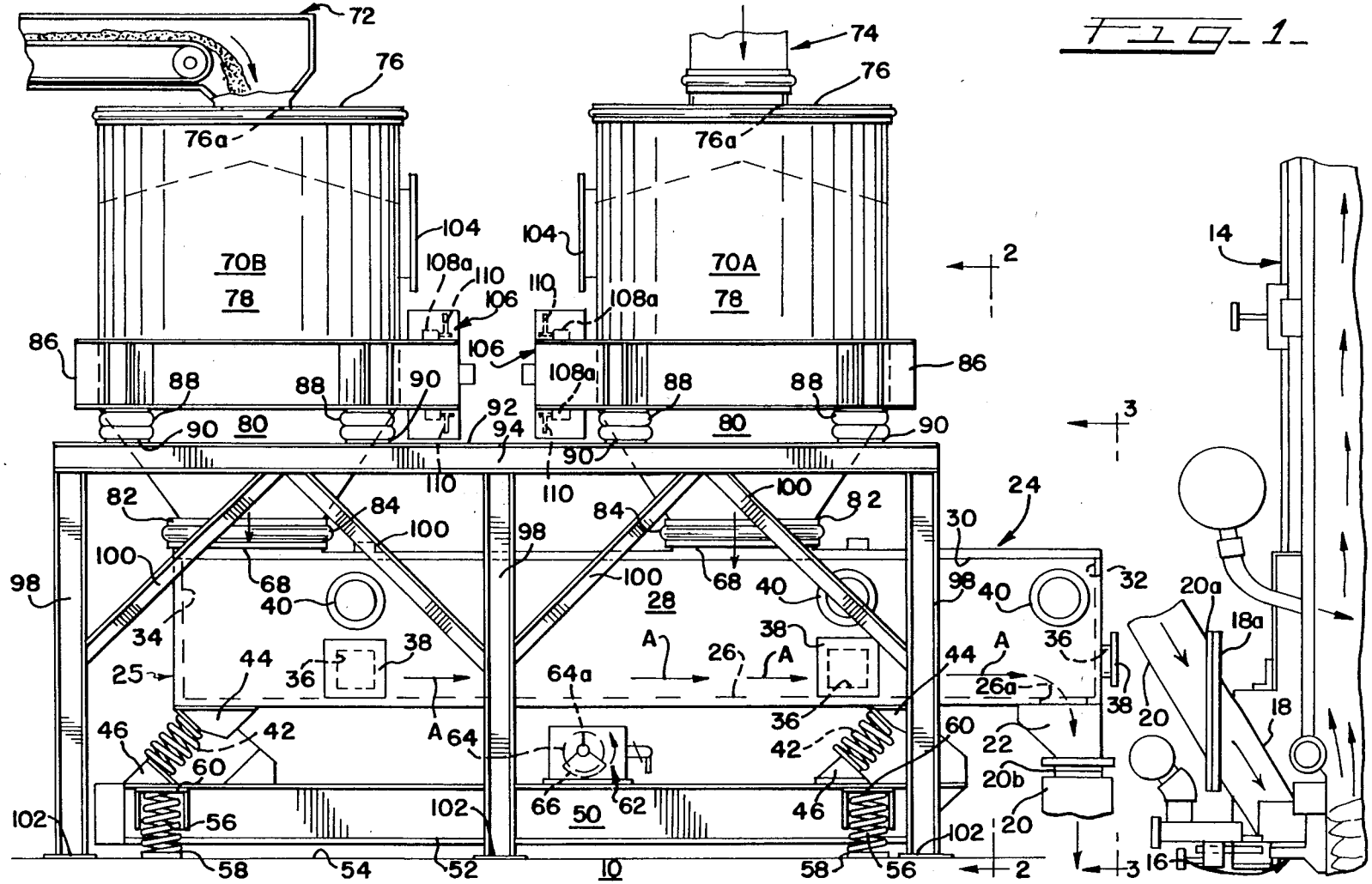
FIG. 1 is a side elevational view of a new and improved system for feeding solid particulate material for burning in a combustion reactor vessel.

Referring now more particularly to the drawings, therein is illustrated and new and improved system for feeding solid particulate material such as refuse derived fuel for combustion in a combustion reactor vessel such as a furnace or steam generating boiler. The system is referred to generally by the reference numeral 10 and is especially adapted to provide a continuous uninterrupted flow of solid particulate material such as refuse derived fuel 12 (FIG. 2) supplied from a plurality of separate sources for combustion in a single combustion reactor vessel such as a steam generator 14.

The steam generator includes a fuel distributor 16 having a downwardly and inwardly sloping feed chute 18 for carrying a stream of refuse derived fuel into the combustion zone of the furnace. The chute is provided with a flange 18a around the outer or receiving inlet end adapted to be connected to a similar flange 20a at the lower or discharge end of an injection chute 20 of the feed system 10. At the upper or inlet end of the injection chute, there is provided an inlet fitting 20b which is in turn connected to the lower end of a discharge spout 22 at the outer or forward end of a generally horizontal, elongated, vibratory feeder 24.

The feeder 24 includes an elongated trough structure supporting a flowing bed of refuse derived fuel or other particulate material to be burned in the steam generator 14 and the bed of material is moved slowly toward a discharge outlet (arrows A) 26a formed in a bottom wall 26 of a trough-like body or structure 25 having a pair of opposite upstanding side walls 28 and a top wall 30. Opposite ends of the trough-like structure 25 are enclosed by a front end wall 32 and a rear end wall 34 of generally rectangular shape so that the entire trough structure forms a relatively dust-tight enclosure.

The side walls 28 and the front end wall 32 are provided with one or more clean out openings 36 at a lower level therein of generally rectangular or square-shaped configuration in order to provide access to the interior of the housing when necessary for clean out or servicing. Each clean out opening is normally covered by dust-tight, plate 38 which is easily removed and readily replaced after needed access is provided. Additionally, the elongated trough-like feed structure 25 is provided with a plurality of porthole-like viewing windows 40 at an elevated level spaced along the side walls 28.

The trough-like enclosure 25 of the vibratory feeder 24 is supported at opposite ends on a plurality of resilient coil springs 42 having upper ends secured to transversely extending cross members 44 mounted on the bottom for supporting the bottom wall 26. At the lower end, each of the coil springs 42 is supported by a cross member 46 which is mounted on the upper surface of a large, generally rectangular counterweight structure 50. The spring axes of each coil spring 42 is sloped upwardly and forwardly from the lower spring support members 46 on the counterweight structure 50 towards the forward end 32 of the trough-like structure 25 to provide a forward direction of flow of the fuel when the feeder is in operation.

The counterweight structure 50 comprises a pair of elongated, relatively heavy "I" beams or "wideflange" beams or channels 52 tied together at opposite ends by the lower, spring support members 46. The counterweight structure is supported from a floor surface or base 54 by a plurality of vertically disposed coil springs 56 having lower end coils mounted on base plates 58 on the floor surface 54. Upper ends of the springs are supportively connected to outwardly extending bracket structures 60 provided on opposite sides of the counterweight 50 at forward and rearward ends thereof. Because the coil springs 56 have vertically aligned axes extending upwardly from the base or floor surface 54 and the axes of the upper springs 42 between the counterweight 50 and the vibratory feeder 24 intersect and slope upwardly and forwardly therefrom, when the counterweight is vibrated the material in the trough-like structure 25 will flow in a forward direction (arrow A) at a flow rate determined by the vibratory input.

In order to vibrate the trough-like structure 25 so that the refuse derived fuel will move in a forward direction as indicated by the arrows "A" and eventually out through the discharge opening 26a in the bottom wall 26, the vibratory feeder 24 is provided with a mechanical vibrator unit 62 powered by an electric motor 64 having a rotor shaft 64a extending outwardly from opposite ends of the motor casing in a direction transverse to the direction of material flow indicated by the arrows "A". Eccentric weights 66 are mounted on opposite end portions of the motor shaft 64a and when the motor is energized at a particular speed by electric current supplied from a controller (not shown) the vibrating input or out-of-balance vibration forces are transmitted from the vibrator unit 62 through the counterweight structure 50 and via the springs 42 to the trough-like enclosure 25 of the vibratory feeder 24. This vibration is isolated somewhat from the supporting floor 54 by the vertical springs 56. The feed rate of a particulate material of a particular density or size is selectively controlled by the speed of the electric motor 64 of the vibrator unit. Thus, for a given particle density and/or size, the flow rate will generally be proportional to the rotor speed of the electric motor 64 and this is electrically controlled by the electric power supplied to the motor.

In accordance with the system 10 of the present invention, the vibratory feeder 24 is provided with a continuous supply of particulate material from a plurality of vibratory feed bins 70A and 70B mounted above the trough-like body 25 at longitudinally spaced intervals rearwardly from the front end wall 32. The vibratory feeder 24 is provided with a pair of upwardly opening inlet sections 68 projecting upwardly from the top wall 30 for feeding interconnection with lower outlets of the feed bins 70A and 70B. The respective feed bins are substantially identical and are adapted to be supplied with material on a sometimes intermittent basis from a plurality of separate sources of supply via belt conveyors, delivery chutes or other feeding devices such as a belt conveyor 72 feeding the bin 70B and the feed chute 74 feeding the bin 70A.

Each feed bin 70A and 70B includes a generally circular top wall 76 having an inlet opening 76a at the center thereof so that downwardly flowing particulate material from the belt conveyor 72 or feed chute 74 will be centered with respect to the bin and generally uniformly distributed therein. Each bin includes an intermediate, cylindrical side wall 78 enclosed by the top wall and adapted to contain a relatively large body or supply of particulate material 12 for feeding into the body 25 of the vibratory feeder 24. At the lower end, each cylindrical portion 78 is joined to the upper end of a frustoconically-shaped, bin end portion 80 having a smaller diameter, cylindrical outlet 82 at the lower end aligned coaxially with an inlet 68 of the vibratory feeder 24. The bin outlets 82 and the respective feeder inlets 68 are interconnected by annular, flexible sealing ring assemblies 84 to accommodate relative movement between the bins 70A and 70B and the vibratory feeder 24 and yet provide a continuous dust-tight sealing arrangement between these components to prevent the escape of fine particulate material as it flows from the bins into the feeder.

In accordance with the present invention, the bins 70A and 70B are supported by annular support ring structures 86 which encircle the intermediate cylindrical bin segments 78 adjacent a lower level thereof and the support rings in turn are supported on a plurality of resilient springs 88 equilaterally spaced around the circumference of each bin body. Lower ends of the springs 88 are seated on base plates 90 mounted on a large, generally rectangular work platform 92 extending horizontally and spaced at a level above the trough-like body 25 of the elongated vibratory feeder 24.

Figure 3:
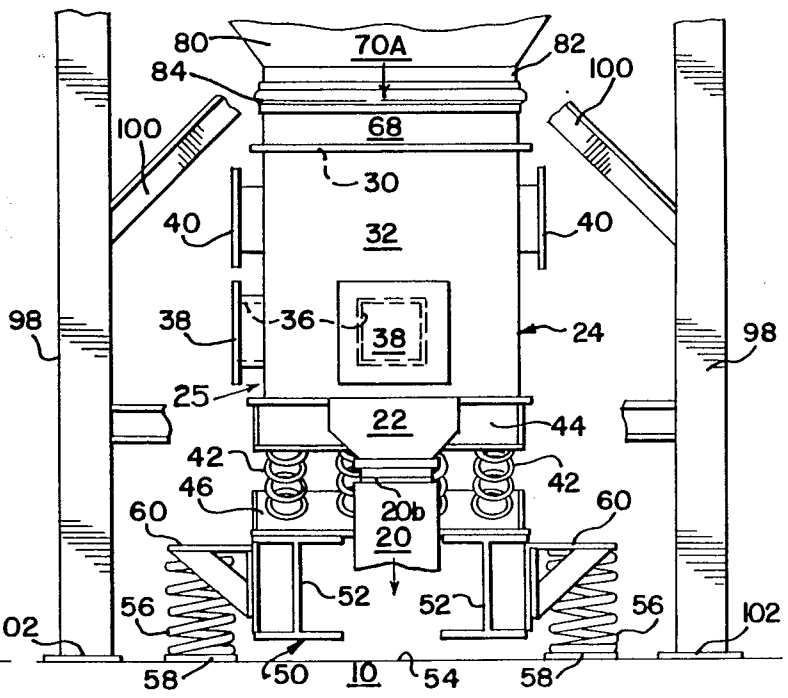
FIG. 3 is another transverse cross-sectional view taken substantially along lines 3—3 of FIG. 1.
Figure 2:
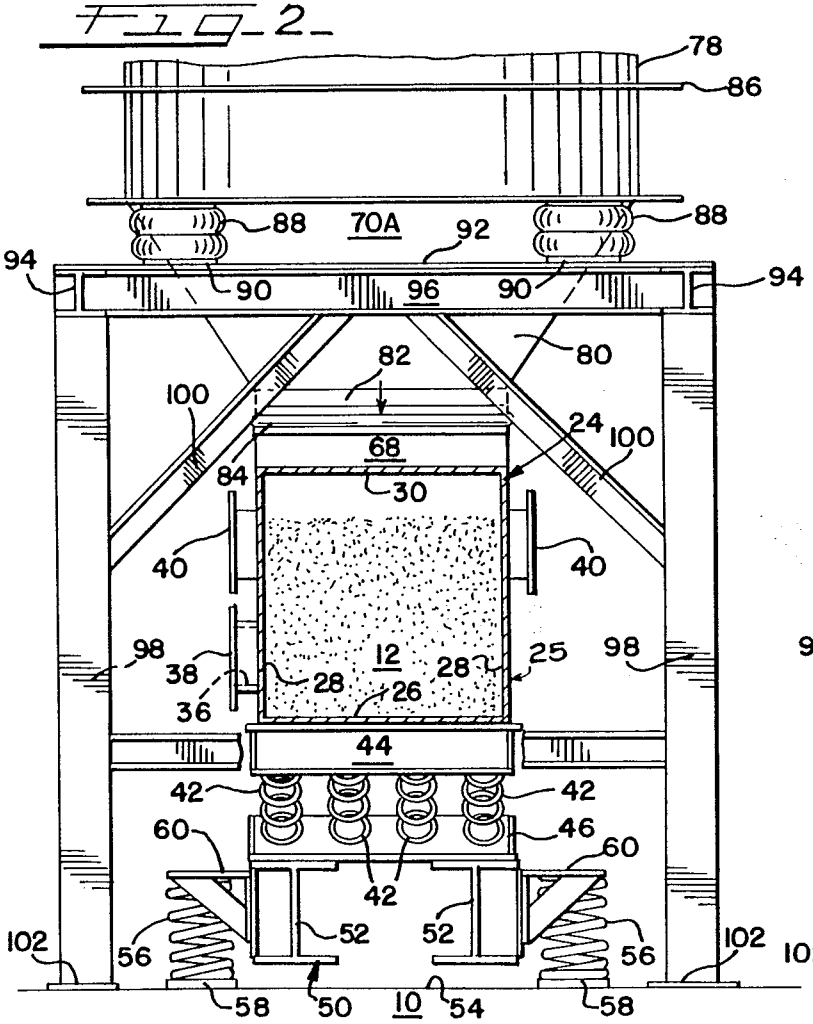
FIG. 2 is a transverse cross-sectional view taken substantially along lines 2—2 of FIG. 1.
Figure 4:
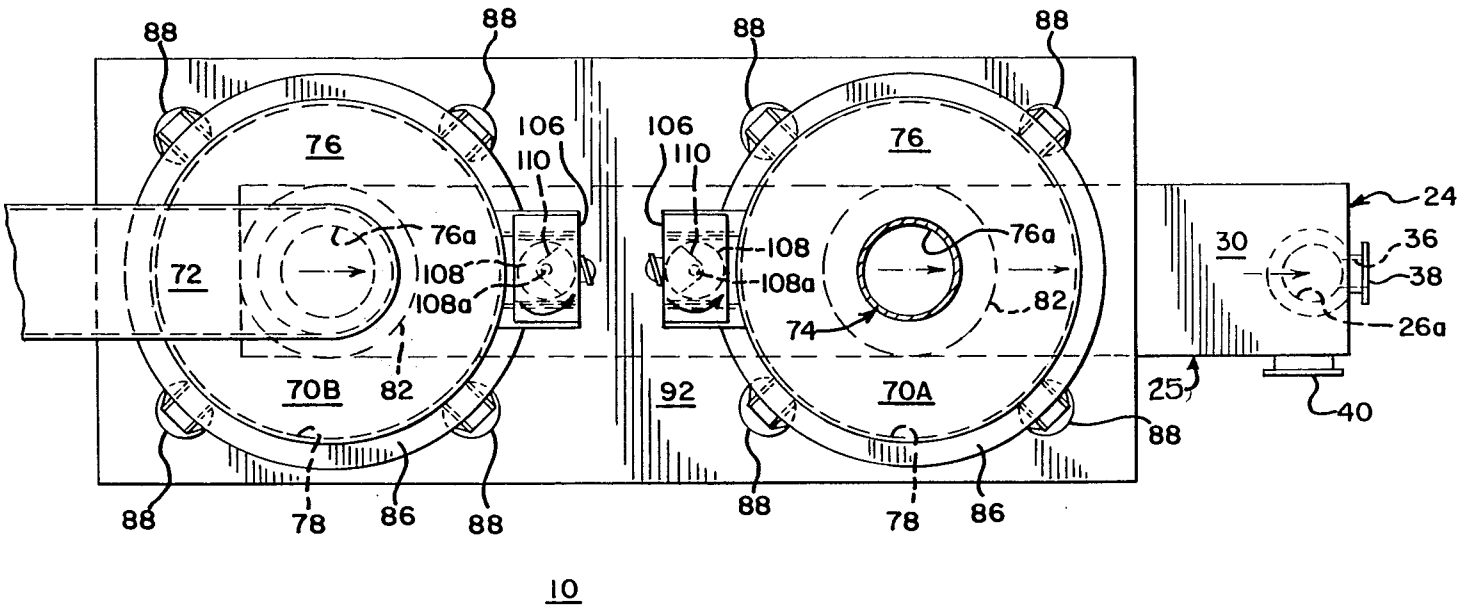
FIG. 4 is a top plan view of the system.

The bin supporting work platform 92 is carried on an underlying frame structure comprising a plurality of longitudinally extending side beams 94 interconnected by transversely extending cross beams 96 to thus provide a strong supporting rectangular base for the work platform for supporting the fuel laden bins 70A and 70B. This bin support structure is supported from the floor 54 on a plurality of vertically extending columns 98 provided at longitudinally spaced apart intervals on opposite sides and outwardly of the trough-like structure 25 of the vibratory feeder 24. A plurality of angle braces 100 are provided to structurally interconnect the support columns 98 and the longitudinal beams 94 and cross beams 96 as shown in FIGS. 1, 2 and 3, and each column is provided with a rectangular base plate 102 at the lower end which is accurately leveled and secured to the supporting surface or floor 54. Each of the bins 70A and 70B is provided with a porthole type viewing window 104 for viewing the interior of the bin as desired.

Because the support platform 92 is independently supported by the column 98 at a level spaced above the floor surface 54 and above the vibratory feeder 24, each individual bin 70A and 70B is isolated from the vibratory feeder. Moreover, each of the bins is resiliently supported relative to the work platform 92 by a plurality of resilient springs 88 connected between the platform and the support ring structure 86 of each bin.

In accordance with the present invention, each bin may be vibrated independently of the other at a selectively controlled rate to feed material contained therein into the feeder 24. The bins may be vibrated to feed on an alternate basis to feed material at controlled flow rates downwardly through outlets 82 into the inlets 68 of the elongated vibratory feeder 24.

For this purpose, each bin is provided with an electrically powered vibrator unit 106 similar to the vibrator unit 62 and employing an electric motor 108 having a vertical rotor shaft **108*a* with counterweights 110** mounted on upper and lower ends thereof.

The system 10 employs a plurality of independent vibrating feed bins 70A and 70B in parallel flow and each bin is adapted to contain and hold a supply of particulate material that is sufficient in size to maintain continuous feeding to the steam generator or boiler 14 in the event of interruption of supply from the feed conveyor 72 or delivery chute 74. In addition, the vibratory feeder 24 and enclosed trough structure thereof contains a sufficient quantity of fuel so that feeding can continue uninterrupted for an extended period of time when neither of the vibrating bins 70A or 70B is active to feed material into the vibratory feeder. The redundancy of supply thus provided enables a selectively controlled and continuous flow of fuel to be supplied to the inlet chute 20 even though the supply of material coming to either bin may be interrupted during the changeover or relocation of a main or primary source of supply. The flow rate of solid particulate material leaving the vibrating feeder 24 to pass downwardly to the injection chute 20 is accurately and independently controllable by the electrical power level supplied to the vibratory unit 62 on a counterweight structure 50 which imparts a vibratory feeding action to the material in the trough-like structure 25 towards the outlet **26*a***.

Although the present invention has been described in terms of a preferred embodiment, it is intended to include those equivalent structures, some of which may be apparent upon reading this description, and others that may be obvious after study and review.

What is claimed and sought to be secured by Letters Patent of the United States is:

1. A system for feeding solid particulate material for burning in a combustion reactor vessel, comprising:

a fuel injector chute having a lower end for directing a flow of said solid particulate material into said vessel and an upper end for receiving said material;

feeder means having a discharge end for delivering a metered flow of said material to said inlet of said injector chute, said feeder means including elongated trough means having a generally horizontal run and first vibratory means for vibrating said trough means for moving said solid particulate material toward a discharge end above said inlet of said injector chute;

a fixed support structure for said trough means and first resilient support means for mounting said trough means on said fixed support structure, said first vibratory means being mounted on said trough means for vibrating said trough means relative to said support structure to move said solid particulate material along said trough means for discharge into said upper end of said injector chute from said discharge end of said trough means;

a plurality of separate, spaced apart feed bins mounted above said feeder means, each bin adapted for holding a reservoir of said solid particulate material and selectively controllable to provide uninterrupted flow of said solid particulate material onto said feeder means, said feed bins having lower discharge outlets positioned in spaced apart relation above said run of said feeder means for independently controllable discharge of material onto said run for movement toward said discharge end of said feeder means; and second resilient support means for mounting said feed bins on a support extending above said trough means and second vibratory means for vibrating each of said feed bins relative to said support,

2. The system of claim 1, including:

conveyor means for supplying solid particulate material from a source thereof to each of said feed bins.

3. The system of claim 1, including:

flexible seal means between said discharge end of said feeder means and said upper end of said fuel injector chute.

4. The system of claim 1, including:

flexible seal means between discharge outlets at the lower end of said bins and said feeder means.

5. The system of claim 4, wherein:

said feeder means includes a dust enclosure over said trough means having longitudinally spaced apart inlets aligned with said discharge outlets of said bins and sealed therewith by said flexible seal means.

6. The system of claim 1, wherein:

said fixed support structure comprises a frame spaced below said trough means and resiliently supported from an underlying surface.

7. The system of claim 6, wherein:

said support comprises an upstanding framework mounted on said underlying surface outwardly of said trough means and said frame.

8. The system of claim 6, wherein:

said frame and said trough means are supportively interconnected by resilient elements.

9. The system of claim 7, wherein:

said upstanding framework includes a plurality of columns on opposite sides of said trough means and cross-members extending between pairs of said columns for supporting said bins.

10. The system of claim 9, wherein: said resilient support means are interconnected between said cross-members and said bins supported thereby.

11. The system of claim 10, wherein:

said vibratory means are mounted on said bins independently of said resilient support means.

* * * * *